US008154502B2

(12) United States Patent
Pak et al.

(10) Patent No.: US 8,154,502 B2
(45) Date of Patent: Apr. 10, 2012

(54) DISPLAY APPARATUS HAVING REDUCED KICKBACK VOLTAGE

(75) Inventors: Sang-Jin Pak, Yongin-si (KR); Young-Ok Cha, Gwangmyeong-si (KR)

(73) Assignee: Samsung Electronics Co., Ltd. (KR)

( * ) Notice: Subject to any disclaimer, the term of this patent is extended or adjusted under 35 U.S.C. 154(b) by 718 days.

(21) Appl. No.: 12/327,256

(22) Filed: Dec. 3, 2008

(65) Prior Publication Data

US 2009/0262058 A1 Oct. 22, 2009

(30) Foreign Application Priority Data

Apr. 17, 2008 (KR) ..... 10-2008-0035698

(51) Int. Cl.
*G09G 3/36* (2006.01)

(52) U.S. Cl. ..... 345/100

(58) Field of Classification Search ..... None
See application file for complete search history.

(56) References Cited

U.S. PATENT DOCUMENTS 5,894,296 A * 4/1999 Maekawa ..... 345/98
7,068,330 B2 * 6/2006 Song et al. ..... 349/39
2008/0180372 A1 * 7/2008 Kim et al. ..... 345/87

FOREIGN PATENT DOCUMENTS

| | | |
|---|---|---|
| JP | 03185428 | 8/1991 |
| KR | 1020060079599 | 7/2006 |
| KR | 1020060082318 | 7/2006 |

* cited by examiner

*Primary Examiner* — Christopher R Lamb
(74) *Attorney, Agent, or Firm* — Cantor Colburn LLP

(57) ABSTRACT

A display apparatus includes; a display panel including a plurality of data lines which receive a data signal, a plurality of gate lines which receive a gate signal and a plurality of pixels, a data driving circuit which provides the data liens with the data signal, and a gate driving circuit which sequentially applies the gate signal to the plurality of gate lines, wherein an area between an $i^{th}$ gate line and an $(i+1)^{th}$ gate line is divided into a plurality of areas by the plurality of data lines, and wherein each area includes first and second pixel areas which are aligned in an extension direction of the data lines, and the first pixel area and the second pixel area are provided with a first pixel connected to the $i^{th}$ gate line and a second pixel connected to the $(i+1)^{th}$ gate line, respectively.

21 Claims, 6 Drawing Sheets

DISPLAY APPARATUS HAVING REDUCED KICKBACK VOLTAGE

This application claims priority to Korean Patent Application No. 2008-35698, filed on Apr. 17, 2008, and all the benefits accruing therefrom under 35 U.S.C. §119, the contents of which in its entirety are herein incorporated by reference.

BACKGROUND OF THE INVENTION

1. Field of the Invention

The present invention relates to a display apparatus. More particularly, the present invention relates to a display apparatus capable of reducing intensity of kickback voltage generated from each pixel.

2. Description of the Related Art

Generally, a liquid crystal display ("LCD") includes a display panel that displays an image, and data and gate driving circuits that provide the display panel with signals to drive the display panel.

The data driving circuit provides a data signal to each of a plurality of data lines formed on the display panel, and the gate driving circuit sequentially provides a gate signal to each of a plurality of gate lines arranged on the display panel, wherein the gate lines are disposed perpendicular to the data lines. Accordingly, a plurality of pixels formed on the display panel are sequentially turned on in the row direction in response to the gate signal, and receive the data signal to display the image corresponding to the data signal. The liquid crystal display adopting such a driving manner displays the image along a scanning direction of the gate driving circuit, e.g., from the top of the display panel to the bottom of the display panel.

However, recently, LCDs have been used as the display device for a television, a monitor and a mobile phone. Of particular interest is the use of an LCD for a display which may be rotated at an angle of 180 degrees according to the intention of the user, and which may change the orientation of the display accordingly, e.g., maintain the orientation of the displayed image despite the change in orientation of the LCD by the user. In this case, if the gate driving circuit is set to be scanned only in one direction, the liquid crystal display cannot display the image having a normal orientation when the liquid crystal display is rotated at an angle of 180 degrees.

Accordingly, a gate driving circuit having the ability to display an image having a normal orientation when the liquid crystal display is rotated at an angle of 180 degrees is desired.

BRIEF SUMMARY OF THE INVENTION

An exemplary embodiment of the present invention provides a display apparatus capable of reducing differential kickback voltage between pixels when a forward scanning and a backward scanning are performed in the display apparatus having a bidirectional scanning function.

In an exemplary embodiment of the present invention, a display apparatus includes; a display panel including a plurality of data lines which receive a data signal, a plurality of gate lines which receive a gate signal and a plurality of pixels which display an image corresponding to the data signal in response to the gate signal, a data driving circuit which provides the plurality of data lines with the data signal, and a gate driving circuit which sequentially applies the gate signal to the plurality of gate lines, wherein an area between an $i^{th}$ gate line of the plurality of gate lines, wherein i represents an odd number equal to or greater than 1, and an $(i+1)^{th}$ gate line of the plurality of gate lines is divided into a plurality of areas by the plurality of data lines, and wherein each area includes a first pixel area and a second pixel area which are aligned in an extension direction of the plurality of data lines, and the first pixel area and the second pixel area are provided with a first pixel connected to the $i^{th}$ gate line and a second pixel connected to the $(i+1)^{th}$ gate line, respectively.

As described above, two adjacent pixel electrodes are aligned closely to each other without interposing a gate line therebetween, thereby reducing differential kickback voltage between pixels when a forward scanning and a backward scanning are performed in the display apparatus having a bidirectional scanning function.

BRIEF DESCRIPTION OF THE DRAWINGS

The above and other advantages of the present invention will become readily apparent by reference to the following detailed description when considered in conjunction with the accompanying drawings wherein.

DETAILED DESCRIPTION OF THE INVENTION

Figure 1:
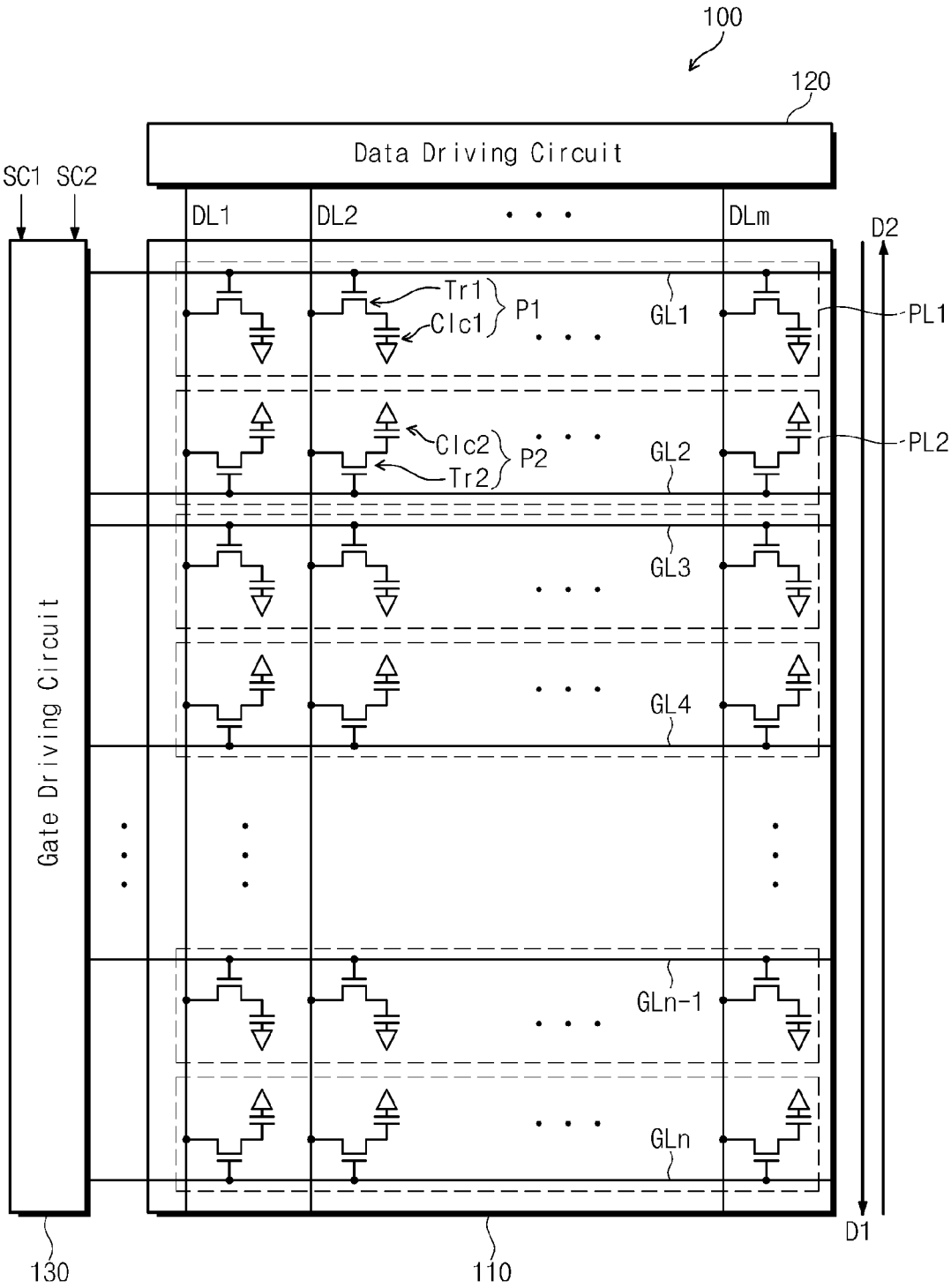
FIG. 1 is a block diagram illustrating an exemplary embodiment of a display apparatus according to the present invention.

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the invention. As used herein, the singular forms "a", "an", and "the" are intended to include the plural forms as well, unless the context clearly indicates otherwise. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation depicted in the figures. For example, if the device in one of the figures is turned over, elements described as being on the "lower" side of other elements would then be oriented on the "upper" side of the other elements. The exemplary term "lower" can therefore encompass both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can therefore encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to cross-sectional illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

Hereinafter, the present invention will be described in more detail with reference to the accompanying drawings.

Figure 2:
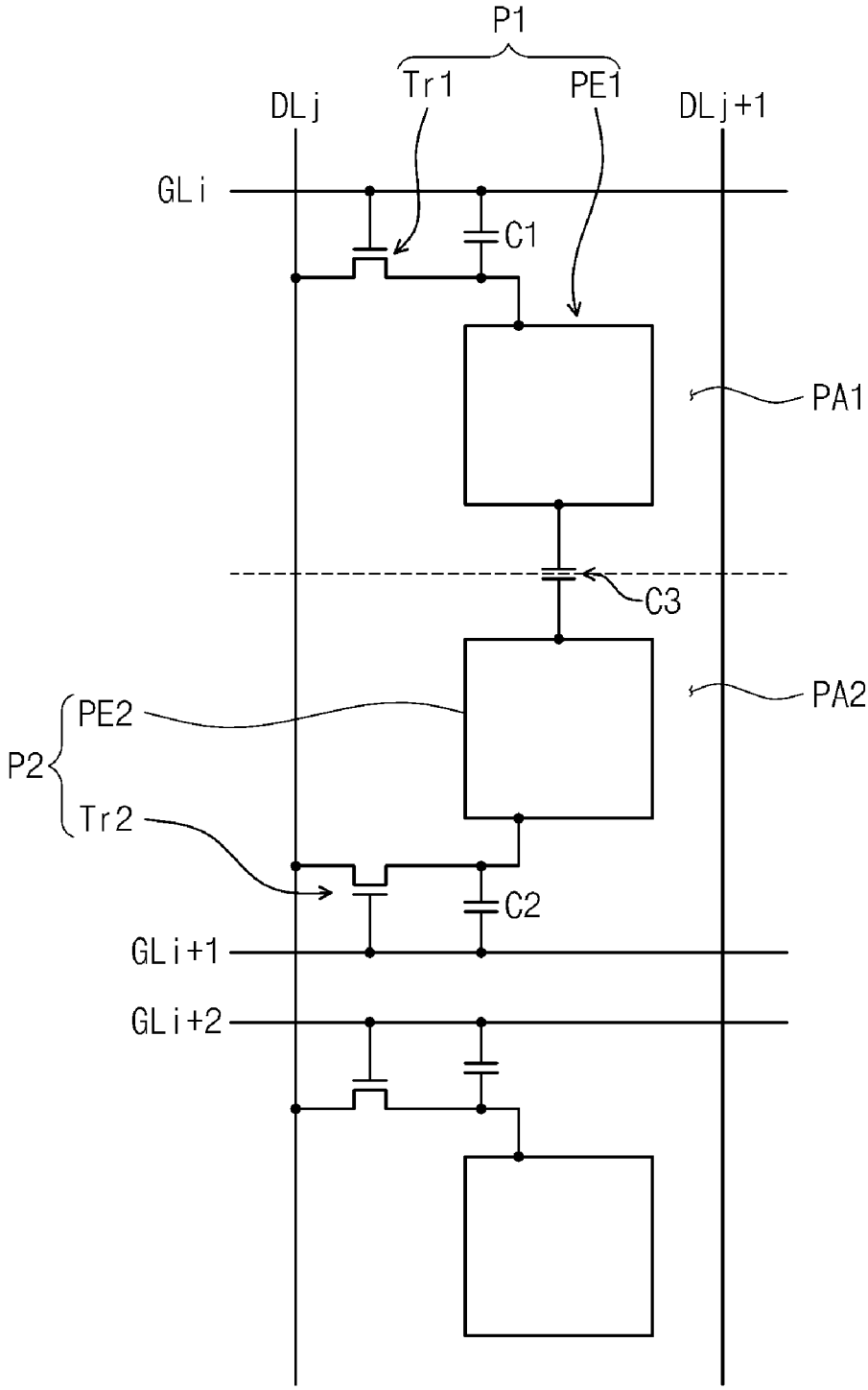
FIG. 2 is an equivalent circuit diagram illustrating an exemplary embodiment of a pixel of the exemplary embodiment of a display panel shown in FIG. 1.

FIG. 1 is a block diagram illustrating an exemplary embodiment of a display apparatus according to the present invention, and FIG. 2 is an equivalent circuit diagram illustrating an exemplary embodiment of a pixel of the exemplary embodiment of a display panel shown in FIG. 1.

Referring to FIG. 1, a display apparatus 100 includes a display panel 110 displaying an image corresponding to a data signal in response to a gate signal, a data driving circuit 120 providing the display panel 110 with the data signal, and a gate driving circuit 130 providing the display panel 110 with the gate signal.

A plurality of data lines DL1 to DLm and a plurality of gate lines GL1 to GLn are formed on the display panel 110. The data lines DL1 to DLm are disposed substantially in parallel with each other while extending in a first direction D1 as shown in FIG. 1. The gate lines GL1 to GLn are disposed substantially in parallel to each other while extending in a direction substantially perpendicular to the data lines DL1 to DLm.

The data driving circuit 120 is connected to at least one end of the data lines DL1 to DLm to provide the data signal to the data lines DL1 to DLm. The gate driving circuit 130 is connected to at least one end of the gate lines GL1 to GLn to sequentially provide the gate signal to the gate lines GL1 to GLn. The gate driving circuit 130 is operated to sequentially supply a plurality of gate signals in a forward direction D1 or a backward direction D2 in response to a first scan selection signal SC1 or a second scan selection signal SC2.

In detail, if the first scan selection signal SC1 is input into the gate driving circuit 130, the gate driving circuit 130 is operated in the forward direction D1 to sequentially provide the gate signal to a first gate line GL1 through an $N^{th}$ gate line GLn. Meanwhile, if the second scan selection signal SC2 is input into the gate driving circuit 130, the gate driving circuit 130 is operated in the backward direction D2 to sequentially provide the gate signal to the $N^{th}$ gate line GLn through the first gate line GL1.

According to the present exemplary embodiment of the present invention, the first and second scan selection signals SC1 and SC2 are output from a timing controller (not shown) which is applied to the display apparatus 100 to control an operation of the gate driving circuit 130 and the data driving circuit 120. Alternative exemplary embodiments include configurations wherein the timing controller is incorporated into the data driving circuit 120.

When the display apparatus 100 is applied to a rotatable module, a direction of operation of the gate driving circuit 130 may be selected as described above, so that the image is displayed in the desired direction.

A first pixel row PL1 and a second pixel row PL2 are formed between odd-numbered gate lines GL1, GL3, . . . and GLn-1 and even-numbered gate lines GL2, GL4, . . . and GLn on the display panel 110. The first pixel row PL1 includes a plurality of first pixels P1 connected to the odd-numbered gate lines GL1, GL3 . . . and GLn-1. The second pixel row PL2 includes a plurality of second pixels P2 connected to the even-numbered gate lines GL2, GL4 . . . and GLn. Each of the first pixels P1 of the first pixel row PL1 includes a first thin film transistor Tr1 and a first liquid crystal capacitor Clc1, and each of the second pixels P2 of the second pixel row PL2 includes a second thin film transistor Tr2 and a second liquid crystal capacitor Clc2.

Each of the first and second liquid crystal capacitors Clc1 and Clc2 includes a pixel electrode, a common electrode facing the pixel electrode and a liquid crystal layer interposed between the pixel electrode and the common electrode. The pixel electrode receives the data signal, which is output from the corresponding thin film transistors Tr1 and Tr2. The common electrode receives common voltage. The pixel electrode and the common electrode are formed on opposing substrates that face each other. In the present exemplary embodiment, the pixel electrode and the thin film transistor are disposed on the same substrate. The liquid crystal layer is interposed between the two substrates.

FIG. 2 is an equivalent circuit diagram illustrating an exemplary embodiment of pixel of the exemplary embodiment of a display panel 110 shown in FIG. 1. The equivalent circuit diagram illustrates a substrate equipped with the pixel electrode and the thin film transistor.

Referring to FIG. 2, the first and second pixels P1 and P2 are disposed between an $i^{th}$ gate line GLi and an $(i+1)^{th}$ gate line GLi+1. In such an exemplary embodiment, i represents an odd number equal to or greater than 1. The first pixel P1 is provided with a first thin film transistor Tr1 and a first pixel electrode PE1, and the second pixel P2 is provided with a second thin film transistor Tr2 and a second pixel electrode PE2.

The first thin film transistor Tr1 includes a gate electrode connected to the $i^{th}$ gate line GLi, a source electrode connected to a $j^{th}$ data line DLj and a drain electrode connected to the first pixel electrode PE1. Accordingly, the first thin film transistor Tr1 applies the data signal, which is provided from the $j^{th}$ data line DLj, to the first pixel electrode PE1 in response to the gate signal applied to the $i^{th}$ gate line GLi.

The second thin film transistor Tr2 includes a gate electrode connected to the $(i+1)^{th}$ gate line GLi+1, a source electrode connected to the $j^{th}$ data line DLj and a drain electrode connected to the second pixel electrode PE2. Accordingly, the second thin film transistor Tr2 applies the data signal, which is provided from the $j^{th}$ data line DLj, to the second pixel electrode PE2 in response to the gate signal applied to the $(i+1)^{th}$ gate line GLi+1.

As shown in FIG. 2, an area between the $i^{th}$ gate line GLi and the $(i+1)^{th}$ gate line GLi+1 is divided into a plurality of regions by the plural data lines DLj, DLj+1, . . . DLm. The area includes a first pixel area PA1 and a second pixel area PA2 which are aligned in an extension direction of the data lines, and the first pixel area PA1 and the second pixel area PA2 are provided with the first pixel P1 and the second pixel P2, respectively.

The first thin film transistor Tr1 is disposed substantially adjacent to an intersection of the $i^{th}$ gate line GLi and $j^{th}$ data line DLj in the first pixel area PA1, and the second thin film transistor Tr2 is disposed substantially adjacent to an intersection of the $(i+1)^{th}$ gate line GLi+1 and $j^{th}$ data line DLj.

The first and second pixel electrodes PE1 and PE2 are formed on the first and second pixel areas PA1 and PA2, respectively, and the first and second pixel electrodes PE1 and the PE2 are disposed substantially adjacent to each other with respect to a boundary between the first and second pixel areas PA1 and PA2.

In a structure in which the first and second pixels P1 and P2 are formed between the $i^{th}$ gate line GLi and $(i+1)^{th}$ gate line GLi+l, a first parasitic capacitance C1 is generated between the drain electrode of the first thin film transistor Tr1 and the $i^{th}$ gate line GLi, and a second parasitic capacitance C2 is generated between the drain electrode of the second thin film transistor Tr2 and the $(i+1)^{th}$ gate line GLi+1. A third parasitic capacitance C3 is generated between the first pixel electrode PE1 and the second pixel electrode PE2.

Such parasitic capacitances lower a pixel voltage eventually applied to the pixel electrodes PE1 and PE2, such as the data signal. In this case, the voltage drop due to the parasitic capacitance is referred to as kickback voltage, and an intensity of the kickback voltage is changed by the parasitic capacitance and voltage variation in the applied pixel voltage.

For example, the total kickback voltage Vk(T) exerting an influence on the pixel voltage applied to the second pixel electrode PE2 in the second pixel P2 is defined as the total amount of a first kickback voltage Vk(C3) of the third parasitic capacitance C3 and a second kickback voltage Vk(C2) of the second parasitic capacitance C2 as expressed by equation 1 described below.

$$Vk(T)=Vk(C3)+Vk(C2) \quad \text{<Equation 1>}$$

Wherein, the first kickback voltage Vk(C3) satisfies Equation 2 described below.

$$Vk(C3)=\frac{C3}{(C3+Cst+Clc)}\times\Delta Vdata \quad \text{< Equation 2 >}$$

Wherein, Cst represents a storage capacitance formed on the second pixel P2, Clc represents a liquid crystal capacitance, and ΔVdata represents a variation of pixel voltage applied to the second pixel electrode PE2.

Meanwhile, the second kickback voltage Vk(C2) satisfies Equation 3 described below.

$$Vk(C2)=\frac{C2}{(C2+Cst+Clc)}\times\Delta Vgate \quad \text{< Equation 3 >}$$

Wherein, ΔVgate represents variation of gate voltage applied to the $i^{th}$ gate line GLi.

Figure 3:
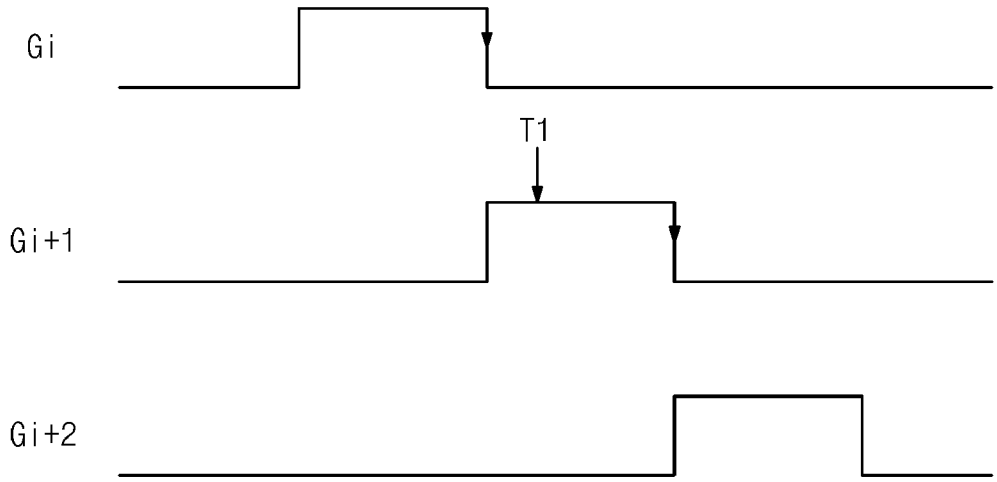
FIG. 3 is a timing chart representing an exemplary embodiment of a waveform of gate signals applied to an $i^{th}$ gate line, an $(i+1)^{th}$ gate line and an $(i+2)^{th}$ gate line shown in FIG. 2 when an exemplary embodiment of a gate driving circuit is operated in a forward direction.
Figure 4:
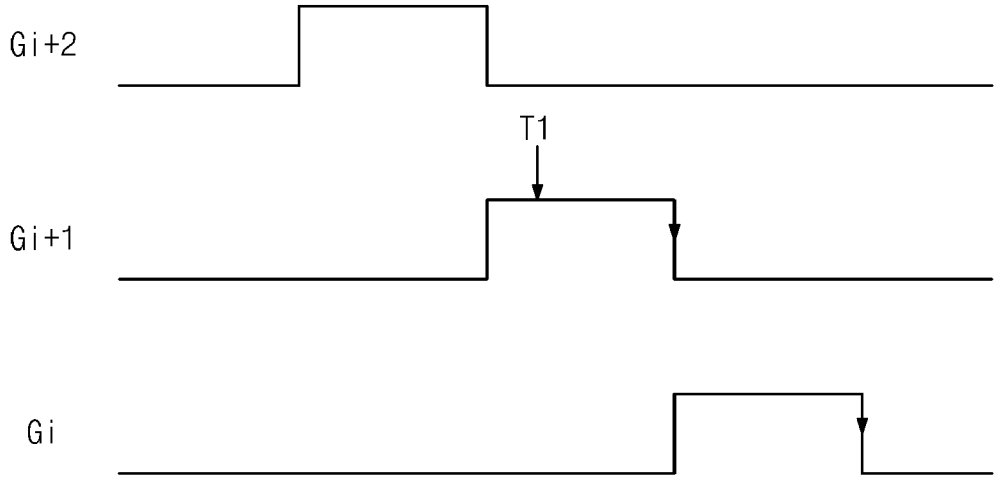
FIG. 4 is a timing chart representing an exemplary embodiment of a waveform of gate signals applied to the $i^{th}$ gate line, the $(i+1)^{th}$ gate line and the $(i+2)^{th}$ gate line shown in FIG. 2 when the exemplary embodiment of a gate driving circuit is operated in a backward direction.

FIG. 3 is a timing chart representing an exemplary embodiment of a waveform of gate signals applied to the $i^{th}$ gate line, the $(i+1)^{th}$ gate line and an $(i+2)^{th}$ gate line shown in FIG. 2 when an exemplary embodiment of the gate driving circuit is operated in the forward direction, and FIG. 4 is a timing chart representing an exemplary embodiment of a waveform of gate signals applied to the $i^{th}$ gate line, the $(i+1)^{th}$ gate line and the $(i+2)^{th}$ gate line shown in FIG. 2 when the exemplary embodiment of a gate driving circuit is operated in the backward direction.

As shown in FIG. 3, if the gate driving circuit 130 is operated in the forward direction, the gate signals are applied in the sequence of the $i^{th}$ gate line GLi, the $(i+1)^{th}$ gate line GLi+1, the $(i+2)^{th}$ gate line GLi+2 and so on through the $n^{th}$ gate line GLn. The gate signals sequentially applied to the $i^{th}$ gate line GLi, the $(i+1)^{th}$ gate line GLi+1 and the $(i+2)^{th}$ gate line GLi+2 are defined as an $i^{th}$ gate signal, an $(i+1)^{th}$ gate signal and an $(i+2)^{th}$ gate signal, respectively.

The second pixel electrode PE2 of the second pixel P2 receives pixel voltage when a predetermined time has lapsed after the $(i+1)^{th}$ gate signal is applied to the $(i+1)^{th}$ gate line GLi+1. The time point at which the pixel voltage is applied to the second pixel electrode PE2 is defined as a data writing time T1. The data writing time T1 is an artifact of the structure of the second thin film transistor Tr2, and the other components of the second pixel P2.

The first kickback voltage Vk(C3) occurs at a falling time of the $i^{th}$ gate signal applied to the $i^{th}$ gate line GLi, and therefore the first kickback voltage Vk(C3) is produced before the data writing time T1. Accordingly, the first kickback voltage Vk(C3) fails to exert an influence on the total kickback voltage Vk(T) of the second pixel P2.

However, the second kickback voltage Vk(C2) occurs at a falling time of the $(i+1)^{th}$ gate signal applied to the $(i+1)^{th}$ gate line GLi+1, and therefore the second kickback voltage Vk(C2) is produced after the data writing time T1. Thus, when the gate driving circuit 130 is operated in the forward direction, the total kickback voltage Vk(T) of the second pixel P2 includes only the second kickback voltage Vk(C2).

Meanwhile, as shown in FIG. 4, if the gate driving circuit 130 is operated in the backward direction, the gate signals are applied in the sequence of the $n^{th}$ gate line GLn through the $(i+2)^{th}$ gate line GLi+2, the $(i+1)^{th}$ gate line GLi+1 and the $i^{th}$ gate line GLi.

The second kickback voltage Vk(C2) included in the total kickback voltage Vk(T) of the second pixel P2 occurs at the falling time of the $(i+1)^{th}$ gate signal applied to the $(i+1)^{th}$ gate line GLi+1. In addition, the first kickback voltage Vk(C3) occurs at the falling time of the $i^{th}$ gate signal applied to the $i^{th}$ gate line GLi. Since both of the first and second kickback voltages Vk(C3) and Vk(C2) occur after the data writing time T1, the total kickback voltage Vk(T) of the second pixel P2 in the backward operation of the gate driving circuit 130 may correspond to the total amount of the first kickback voltage Vk(C3) and the second kickback voltage Vk(C2).

As a result, the intensity of total kickback voltage Vk(T) of each pixel is changed depending on the direction of operation of the gate driving circuit 130, that is, the forward direction or the backward direction. In particular, the total kickback voltage Vk(T) of each pixel in the forward operation is different from the total kickback voltage Vk(T) of each pixel in the backward operation by the intensity of the first kickback voltage Vk(C3). As described above, the intensity of first kickback voltage Vk(C3) is determined by the parasitic capacitance between the pixel electrodes and the variation ΔVdata of the pixel voltage applied to the pixel electrode.

However, according to the conventional structure in which a pixel electrode of a present stage is adjacent to a gate line of a next stage, the intensity of the kickback voltage Vk(C3) is determined by parasitic capacitance between the pixel electrode of the present stage and the gate line of the next stage and the variation ΔVgate of gate voltage applied to the gate line of the next stage. In general, the gate voltage is about four times greater than the pixel voltage.

According to the present exemplary embodiment of the present invention, the first kickback voltage Vk(C3) is reduced into a quarter of the conventional first kickback voltage by adopting a structure, in which the pixel electrode of the present stage is disposed adjacent to the pixel electrode of the next stage without being adjacent to the gate line of the next stage. As a result, a difference of total kickback voltage Vk(T) between the forward and rearward operations of the gate driving circuit 130 may be reduced.

Figure 5:
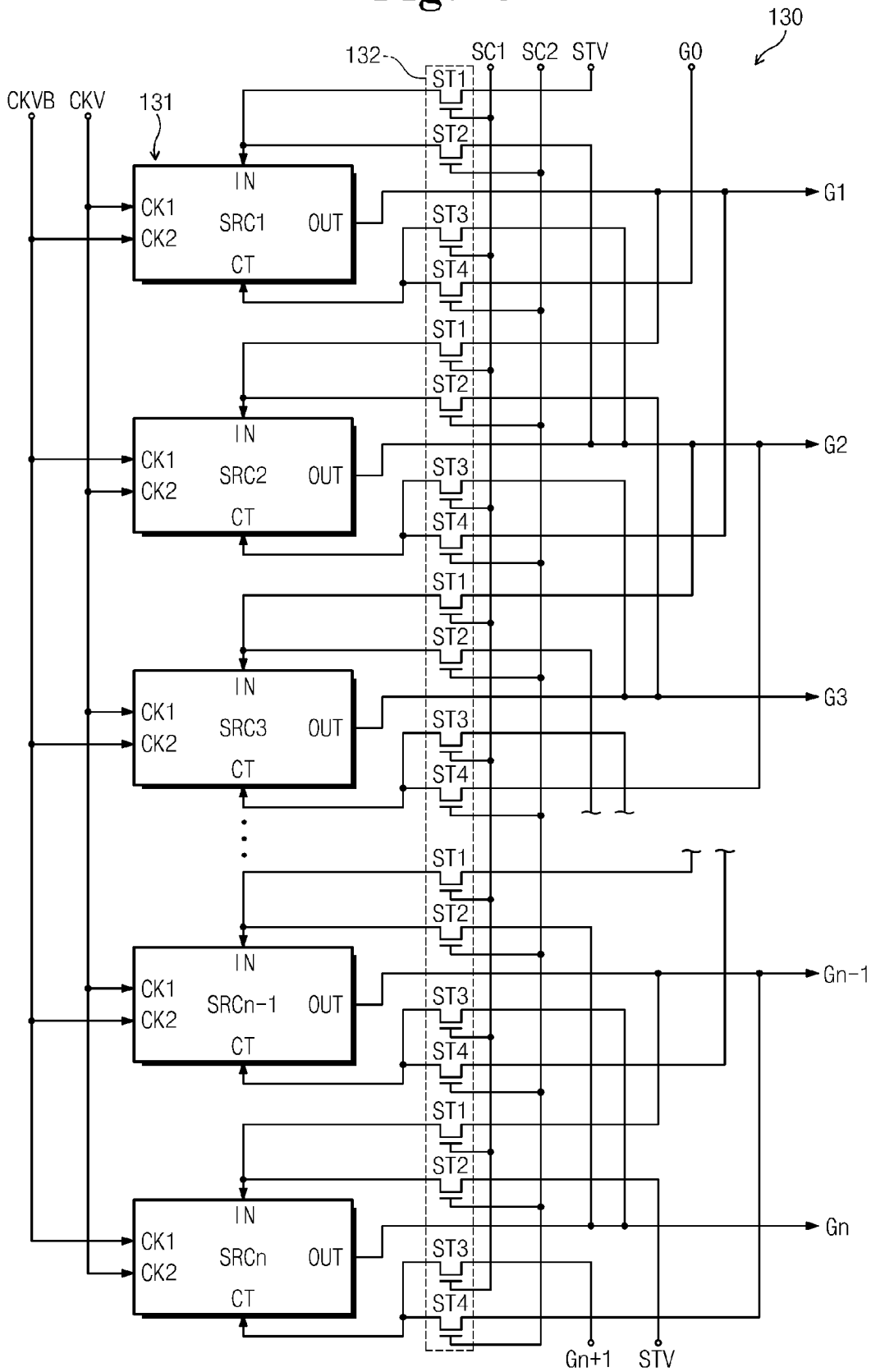
FIG. 5 is a block diagram illustrating the exemplary embodiment of a gate driving circuit shown in FIG. 1.

FIG. 5 is a block diagram illustrating the exemplary embodiment of a gate driving circuit shown in FIG. 1. Referring to FIG. 5, an exemplary embodiment of the gate driving circuit 130 includes a shift register 131 and a scan direction selection unit 132.

The shift register 131 includes a plurality of stages SRC1 through SRCn sequentially connected to each other. Each stage is provided with an input terminal IN, a control terminal CT, a first clock terminal CK1, a second clock terminal CK2 and an output terminal OUT. The input terminal IN receives a gate signal of one of a previous stage and a next stage. In addition, the control terminal CT receives the gate signal from one of the next stage and the previous stage. The output terminal OUT outputs gate signals to one of the plurality of gate lines GL1 through GLn.

Meanwhile, the first clock terminal CK1 receives one of a first clock signal CKV and a second clock signal CKVB having an opposite phase to that of the first clock signal CKV. The second clock terminal CK2 receives the remaining clock signal other than the clock signal which is input to the first clock terminal CK1. In detail, the first clock terminal CK1 and the second clock terminal CK2 of odd-numbered stages SRC1, SRC3, . . . and SRCn-1 receive the first clock signal CKV and the second clock signal CKVB, respectively. The first clock terminal CK1 and the second clock terminal CK2 of even-numbered stages SRC2, SRC4, . . . and SRCn receive the second clock signal CKVB and the first clock signal CKV, respectively.

In the present exemplar embodiment, the scan direction selection unit 132 includes first to fourth switching transistors ST1, ST2, ST3 and ST4. The first switching transistor ST1 provides the gate signal of the previous stage to the input terminal IN of each stage in response to the first scan selection signal SC1, or for the first stage the first switching transistor ST1 provides a start signal STV as will be discussed in more detail below. The second switching transistor ST2 provides the gate signal of the next stage to the input terminal IN of the each stage in response to the second scan selection signal SC2, or for the final stage the second switching transistor ST2 provides a start signal STV as will be discussed in more detail below. In one exemplary embodiment, the start signal STV is the same signal supplied to the first switching transistor ST1 of the first stage and the second switching transistor ST2 of the final stage. In one exemplary embodiment, the first scan selection signal SC1 and the second scan selection signal SC2 have opposite phase to each other.

The third switching transistor ST3 provides the control terminal CT of each stage with the gate signal of the next stage in response to the first scan selection signal SC1. The fourth switching transistor ST4 provides the control terminal CT of each stage with the gate signal of the previous stage in response to the second scan selection signal SC2.

Figure 6:
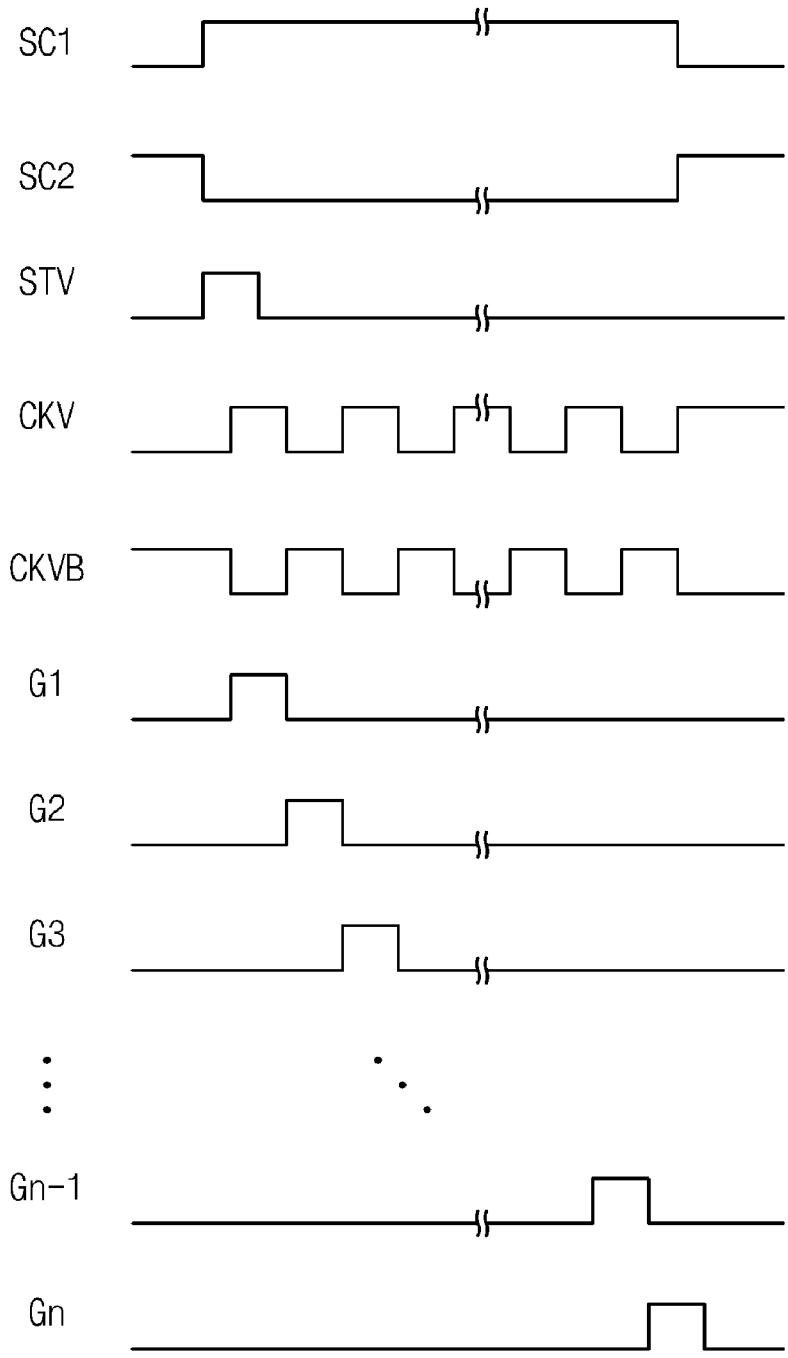
FIG. 6 is a timing chart representing an exemplary embodiment of a waveform of gate signals when the exemplary embodiment of a gate driving circuit shown in FIG. 5 is operated in the forward direction.

FIG. 6 is a timing chart representing an exemplary embodiment of a waveform of gate signals when the exemplary embodiment of a gate driving circuit shown in FIG. 5 is operated in the forward direction.

As shown in FIG. 6, if the gate driving circuit 130 is operated in the forward direction in response to the first scan selection signal SC1, the gate signal of the previous stage is provided to the input terminal IN of the stages SRC2 to SRCn, and the gate signal of the next stage is provided to the control terminal CT (as mentioned above, the first stage SRC1 receives the start signal STV in response to the first scan selection SC1). Accordingly, the stages SRC1 to SRCn are sequentially operated in the sequence of the first stage SRC1 to the $n^{th}$ stage SRCn to sequentially output a first gate signal G1 to an $n^{th}$ gate signal Gn.

Referring to FIG. 5, the input terminal IN of the first stage SRC1 receives the start signal STV other than the gate signal of the previous stage. Although not shown in the drawings, in one exemplary embodiment, the shift register 131 may have a first dummy stage to provide the control terminal CT of the $n^{th}$ stage SRCn with the gate signal of the next stage Gn+1.

Figure 7:
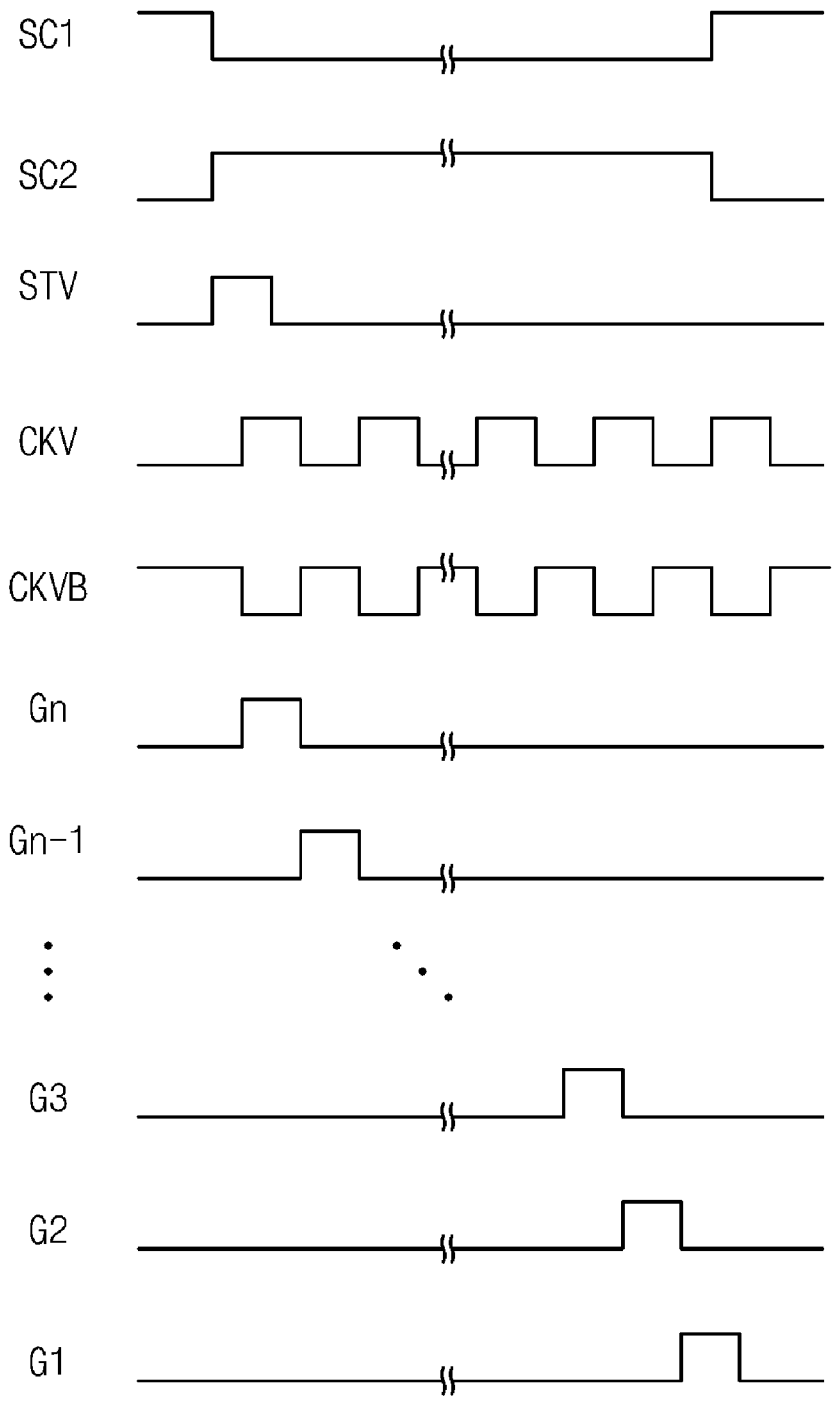
FIG. 7 is a timing chart representing an exemplary embodiment of a waveform of gate signals when the exemplary embodiment of a gate driving circuit shown in FIG. 5 is operated in the backward direction.

FIG. 7 is a timing chart representing an exemplary embodiment of a waveform of gate signals when the exemplary embodiment of a gate driving circuit shown in FIG. 5 is operated in the backward direction.

As shown in FIG. 7, if the gate driving circuit 130 is operated in the backward direction in response to the second scan selection signal SC2, the gate signal of the next stage is provided to the input terminal IN of the stages SRC1 to SRCn, and the gate signal of the previous stage is provided to the control terminal CT (as mentioned above, the final stage SRCn receives the start signal STV in response to the second scan selection SC2). Accordingly, the stages SRC1 to SRCn are sequentially operated in the sequence of the $n^{th}$ stage SRCn to the first stage SRC1 to sequentially output the $n^{th}$ gate signal Gn to the first gate signal G1.

Referring to FIG. 5, the input terminal IN of the n stage SRCn receives a start signal STV other than the gate signal of the next stage. Although not shown in the drawings, in one exemplary embodiment, the shift register 131 may have a second dummy stage to provide the control terminal CT of the first stage SRC1 with the gate signal of the previous stage G0.

According to the exemplary embodiments of a display apparatus described above, two adjacent pixel electrodes are aligned closely to each other without interposing the gate line therebetween, thereby reducing the differential kickback voltage between pixels when the forward scanning and the backward scanning are performed in the display apparatus having the bidirectional scanning function.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A display apparatus comprising:

a display panel including a plurality of data lines which receive a data signal, a plurality of gate lines which receive a gate signal and a plurality of pixels which display an image corresponding to the data signal in response to the gate signal;

a data driving circuit which provides the plurality of data lines with the data signal; and a gate driving circuit which sequentially applies the gate signal to the plurality of gate lines, wherein an area between an $i^{th}$ gate line of the plurality of gate lines, wherein i represents an odd number equal to or greater than 1, and an $(i+1)^{th}$ gate line of the plurality of gate lines is divided into a plurality of areas by the plurality of data lines, and wherein each area includes a first pixel area and a second pixel area which are aligned in an extension direction of the plurality of data lines, and the first pixel area and the second pixel area are provided with a first pixel connected to the $i^{th}$ gate line and a second pixel connected to the $(i+1)^{th}$ gate line, respectively, wherein the $i^{th}$ gate line and the $(i+1)^{th}$ gate line are connected to a same gate driving circuit, and an area between the $(i+1)^{th}$ gate line and an $(i+2)^{th}$ gate line of the plurality of gate lines is defined as a non-pixel area in which the first and second pixels are not disposed.

2. The display apparatus of claim 1, wherein the gate driving circuit sequentially applies the gate signal to the plurality of gate lines in a first direction in response to a first scan selection signal, and sequentially applies the gate signal to the plurality of gate lines in a second direction in opposition to the first direction in response to a second scan selection signal.

3. The display apparatus of claim 2, wherein the first pixel comprises:

a first thin film transistor electrically connected to a corresponding data line of the plurality of data lines and the $i^{th}$ gate line; and a first pixel electrode connected to the first thin film transistor, and wherein the second pixel comprises:

a second thin film transistor electrically connected to a corresponding data line of the plurality of data lines and the $i+1^{th}$ gate line; and a second pixel electrode connected to the second thin film transistor.

4. The display apparatus of claim 3, wherein the first and second pixel electrodes are disposed adjacent to each other at a boundary between the first and second pixel areas.

5. The display apparatus of claim 4, wherein the first thin film transistor is disposed adjacent to an intersection between the $i^{th}$ gate line and the corresponding data line, and the second thin film transistor is disposed adjacent to an intersection between the $(i+1)^{th}$ gate line and the corresponding data line.

6. The display apparatus of claim 3, wherein the gate driving circuit comprises:

a shift register including a plurality of stages sequentially connected to each other which sequentially output the gate signal in one of the first direction and the second direction; and a scan direction selection unit which selects a direction of operation of the shift register in response to at least one of the first and second scan selection signals.

7. The display apparatus of claim 6, wherein each of the stages comprises:

an input terminal which receives one of a gate signal of a previous stage and a gate signal of a next stage;

a control terminal which receives one of the gate signal of the next stage and the gate signal of the previous stage; and an output terminal which outputs the gate signal applied to one of the plurality of gate lines.

8. The display apparatus of claim 7, wherein the scan direction selection unit comprises:

a first switching transistor which provides the input terminal with the gate signal of the previous stage in response to the first scan selection signal;

a second switching transistor which provides the input terminal with the gate signal of the next stage in response to the second scan selection signal;

a third switching transistor which provides the control terminal with the gate signal of the next stage in response to the first scan selection signal; and a fourth switching transistor which provides the control terminal with the gate signal of the previous stage in response to the second scan selection signal.

9. The display apparatus of claim 2, wherein the gate driving circuit comprises:

a shift register including a plurality of stages sequentially connected to each other which sequentially output the gate signal in one of the first direction and the second direction; and a scan direction selection unit which selects a direction of operation in the shift register in response to at least one of the first and second scan selection signals.

10. The display apparatus of claim 9, wherein each of the stages comprises:

an input terminal which receives one of a gate signal of a previous stage and a gate signal of a next stage;

a control terminal which receives one of the gate signal of the next stage and the gate signal of the previous stage; and an output terminal which outputs the gate signal applied to the gate lines.

11. The display apparatus of claim 10, wherein the scan direction selection unit comprises:

a first switching transistor which provides the input terminal with the gate signal of the previous stage in response to the first scan selection signal;

a second switching transistor which provides the input terminal with the gate signal of the next stage in response to the second scan selection signal;

a third switching transistor which provides the control terminal with the gate signal of the next stage in response to the first scan selection signal; and a fourth switching transistor which provides the control terminal with the gate signal of the previous stage in response to the second scan selection signal.

12. The display apparatus of claim 2, wherein the first pixel comprises:

a first thin film transistor electrically connected to a corresponding data line of the plurality of data lines and the $i^{th}$ gate line; and a first pixel electrode connected to the first thin film transistor, and wherein the second pixel comprises:

a second thin film transistor electrically connected to a corresponding data line of the plurality of data lines and the $(i+1)^{th}$ gate line; and a'second pixel electrode connected to the second thin film transistor.

13. The display apparatus of claim 12, wherein the first and second pixel electrodes are disposed adjacent to each other at a boundary between the first and second pixel areas.

14. The display apparatus of claim 13, wherein the first thin film transistor is disposed adjacent to an intersection between the $i^{th}$ gate line and the corresponding data line, and the second thin film transistor is disposed adjacent to an intersection between the $(i+1)^{th}$ gate line and the corresponding data line.

15. The display apparatus of claim 12, wherein the gate driving circuit comprises:

a shift register including a plurality of stages sequentially connected to each other which sequentially output the gate signal in one of the first direction and the second direction opposite to the first direction; and a scan direction selection unit which selects a direction of operation of the shift register in response to the first and second scan selection signals.

16. The display apparatus of claim 15, wherein each of the stages comprises:

an input terminal which receives one of a gate signal of a previous stage and a gate signal of a next stage;

a control terminal which receives one of the gate signal of the next stage and the gate signal of the previous stage; and an output terminal which outputs the gate signal applied to one of the plurality of gate lines.

17. The display apparatus of claim 16, wherein the scan direction selection unit comprises:

a first switching transistor which provides the input terminal with the gate signal of the previous stage in response to the first scan selection signal;

a second switching transistor which provides the input terminal with the gate signal of the next stage in response to the second scan selection signal;

a third switching transistor which provides the control terminal with the gate signal of the next stage in response to the first scan selection signal; and a fourth switching transistor which provides the control terminal with the gate signal of the previous stage in response to the second scan selection signal.

18. The display apparatus of claim 2, wherein the gate driving circuit comprises:

a shift register including a plurality of stages sequentially connected to each other which sequentially output the gate signal in one of the first direction and the second direction opposite to the first direction; and a scan direction selection unit which selects a direction of operation in the shift register in response to the first and second scan selection signals.

19. The display apparatus of claim 18, wherein each of the stages comprises:

an input terminal which receives one of a gate signal of a previous stage and a gate signal of a next stage;

a control terminal which receives one of the gate signal of the next stage and the gate signal of the previous stage; and an output terminal which outputs the gate signal applied to one of the plurality of gate lines.

20. The display apparatus of claim 19, wherein the scan direction selection unit comprises:

a first switching transistor which provides the input terminal with the gate signal of the previous stage in response to the first scan selection signal;

a second switching transistor which provides the input terminal with the gate signal of the next stage in response to the second scan selection signal;

a third switching transistor which provides the control terminal with the gate signal of the next stage in response to the first scan selection signal; and a fourth switching transistor which provides the control terminal with the gate signal of the previous stage in response to the second scan selection signal.

21. A method of operating a bi-directional display device, the method comprising:

providing a data signal to a plurality of data lines disposed on the bi-directional display device;

sequentially providing a gate signal in a first direction to each of a plurality of gate lines disposed on the bi-directional display device when the bi-directional display device is disposed in a first orientation; and sequentially providing a gate signal in a second direction, substantially opposite to the first direction, to each of the plurality of gate lines disposed on the bi-directional display device when the bi-directional display device is disposed on a second orientation, substantially opposite to the first orientation, wherein an area between an $i^{th}$ gate line of the plurality of gate lines, wherein i represents an odd number equal to or greater than 1, and an $(i+1)^{th}$ gate line of the plurality of gate lines is divided into a plurality of areas by the plurality of data lines, and wherein each area includes a first pixel area and a second pixel area which are aligned in an extension direction of the plurality of data lines, and the first pixel area and the second pixel area are provided with a first pixel connected to the $i^{th}$ gate line and a second pixel connected to the $(i+1)^{th}$ gate line, respectively, wherein the $i^{th}$ gate line and the $(i+1)^{th}$ gate line are connected to a same gate driving circuit, and an area between the $(i+1)^{th}$ gate line and an $(i+2)^{th}$ gate line of the plurality of gate lines is defined as a non-pixel area in which the first and second pixels are not disposed.

* * * * *